United States Patent [19]

Chaney et al.

[11] Patent Number: 4,958,816

[45] Date of Patent: Sep. 25, 1990

[54] STIRRUP ASSEMBLY FOR EXAMINATION TABLE

[75] Inventors: David B. Chaney, Powell; John H. Oldiges, Minster; Bart L. Milbourn, Versailles, all of Ohio

[73] Assignee: Midmark Corporation, Versailles, Ohio

[21] Appl. No.: 438,383

[22] Filed: Nov. 20, 1989

[51] Int. Cl.[5] ..... A61G 13/00

[52] U.S. Cl. ..... 269/328; 403/59; 403/95

[58] Field of Search ..... 269/322–328, 269/74, 80, 69; 128/69, 71, 33; 403/59, 95

[56] References Cited

U.S. PATENT DOCUMENTS

| | | | |
|---|---|---|---|
| 2,714,541 | 8/1955 | Reichert et al. . | |
| 3,100,129 | 8/1963 | Adolphson | 269/328 |
| 3,318,596 | 5/1967 | Herzog . | |
| 3,810,462 | 5/1974 | Szpur | 403/54 |
| 3,871,637 | 3/1975 | Mueller et al. . | |
| 4,284,268 | 8/1981 | Gauthier . | |
| 4,547,092 | 10/1985 | Vetter et al. | 403/59 |
| 4,865,484 | 9/1989 | McConnell | 403/59 |

*Primary Examiner*—Robert C. Watson

*Attorney, Agent, or Firm*—Biebel, French & Nauman

[57] ABSTRACT

A stirrup assembly for an examination table includes in a single unit mechanism for adjusting both longitudinally and laterally the positions of limb support bars associated with the table. The limb support bars may be locked with a mechanical interlock in various lateral positions and frictionally fixed against longitudinal movement.

14 Claims, 7 Drawing Sheets

44
43
42
40
40
29
38
30
74
76
66
72
67
65
70
81
68
D2
59
57
57
56
54
60
50
61
63
D2
30
35
35
33
28

232
244
243
242
230
231
227
230
298
265
276
268
270
272
297
262
260
259
261
263
250

STIRRUP ASSEMBLY FOR EXAMINATION TABLE

BACKGROUND OF THE INVENTION

The present invention relates generally to medical examination tables, and more particularly, to a stirrup assembly for such tables.

Certain physical examinations are done on medical examination tables equipped with stirrup assembles. Due to the variety of positions which may need to be assumed for a thorough examination, it is desirable that the table permit longitudinal as well as lateral adjustment of the stirrups.

U.S. Pat. No. 2,714,541 discloses an examination table having stirrups which are longitudinally adjustable along limb support bars. Although the limb support bars themselves can swivel, their length is fixed. A disadvantage of this construction is that when the stirrups are positioned close to the examination table, the protruding ends of the limb support bar can be accidentally bumped by the health care professional conducting the examination.

U.S. Pat. No. 3,318,596 also discloses a medical examination table. The limb supports of this table are not capable of independent longitudinal adjustment. A problem with this table is that an examination position may require one leg be in an extended stirrup, while the other leg is in a stirrup which is retracted.

While U.S. Pat. No. 3,871,637 discloses apparatus which provides for longitudinal adjustment of limb support bars, there is no suggestion that the bars be laterally adjustable.

Finally, U.S. Pat. No. 4,284,268 discloses a medical examination table having a pair of limb support bars which are longitudinally slidable within independent swivel collars. Positioned inwardly from the swivel collars are swivel locks, which comprise downwardly opening slots for loosely receiving the limb support bars. Thus, two separate mechanisms are employed, one for adjusting the limb support bars longitudinally and another for adjusting them laterally.

It will be seen, therefore, that none of the medical examination tables noted above provides a compact, unitary mechanism that permits both longitudinal and lateral adjustment of limb support bars. It is thus apparent that a need exists for an improved medical examination table incorporating in a single compact unit means for both longitudinally and laterally adjusting and locking in selected positions the stirrups thereof.

SUMMARY OF THE INVENTION

The stirrup assembly of the present invention comprises a housing which includes a bottom and top, with the top having formed therein angular displacement retention means. The stirrup assembly also comprises a pivot boss which includes a base and an upper portion. The upper portion has formed therethrough a channel for slidably receiving a limb support bar. The channel also has a first limb support bar engaging surface. The stirrup assembly further includes a locking shoe having front and rear portions. The front portion has an aperture formed therein, through which extends the upper portion of the pivot boss, while the rear portion of the locking shoe has locking means and a second limb support bar engaging surface.

The angular displacement retention means preferably comprises a plurality of openings into which locking means are mechanically interengaged to provide selective angular adjustment of the limb support bar in a generally horizontal plane.

Additionally, the first and second limb support bar engaging surfaces cooperate with the limb support bar to provide selective longitudinal adjustment thereof. Furthermore, the base of the pivot boss extends into the bottom of the housing, while the upper portion of the pivot boss extends into the top of the housing, the base being of a smaller diameter than that of the upper portion.

Attached to the locking shoe is a spring plate, which carries near its outer end the locking means. Additionally, angular displacement stops, which extend between the top and the bottom of the housing, cooperate with the locking shoe to limit the lateral angular displacement of the limb support bar.

Other objects and advantages of the invention will be apparent from the following description, the accompanying drawings and the appended claims.

DETAIL DESCRIPTION OF THE PREFERRED EMBODIMENT

Figure 1:
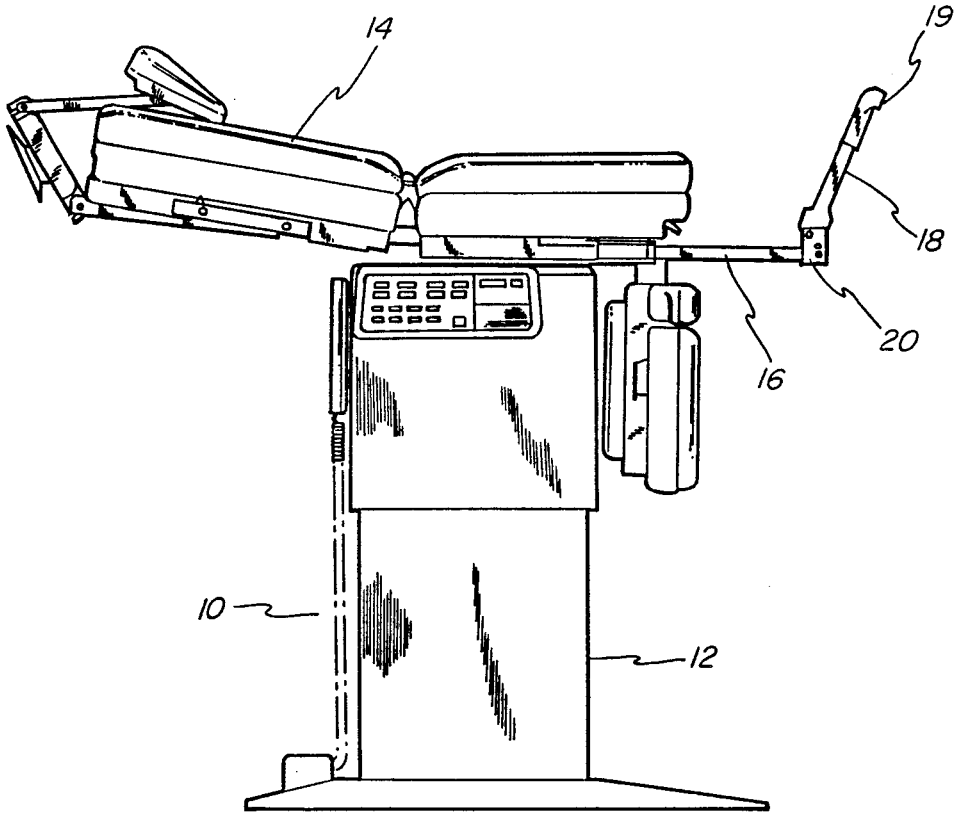
FIG. 1 is a side elevational view of a medical examination table, which includes a stirrup assembly in accordance with the present invention.
Figure 2:
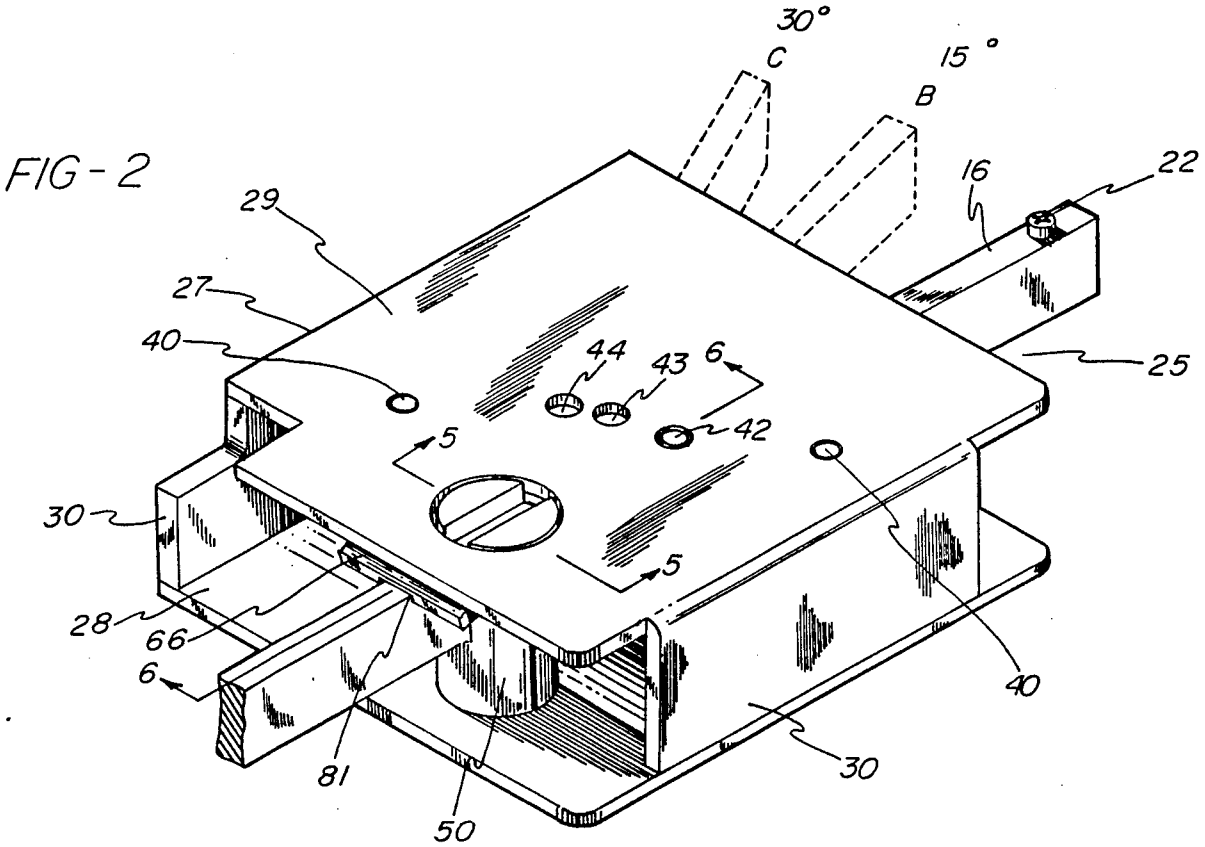
FIG. 2 is a perspective view of the stirrup assembly in accordance with the present invention.

Having reference to the drawings, attention is directed to FIG. 1, which illustrates a medical examination table 10, including a stirrup assembly 11 in accordance with the present invention. Table 10 comprises a base 12, a cushion 14 and a pair of limb support bars 16, only one of which is seen in FIG. 1. At the outer end of each limb support bar is a stirrup 18 having a foot cup 19. The stirrup 18 is attached to the limb support bar 16 by pivot member 20 which may be of conventional construction. As best shown in FIG. 2, each limb support bar is slidably adjustable in a longitudinal direction with respect to the table 10, with removal of the limb support bar 16 being prevented by a bar retaining pin 22 located on the upper surface of the limb support bar 16.

Figure 3:
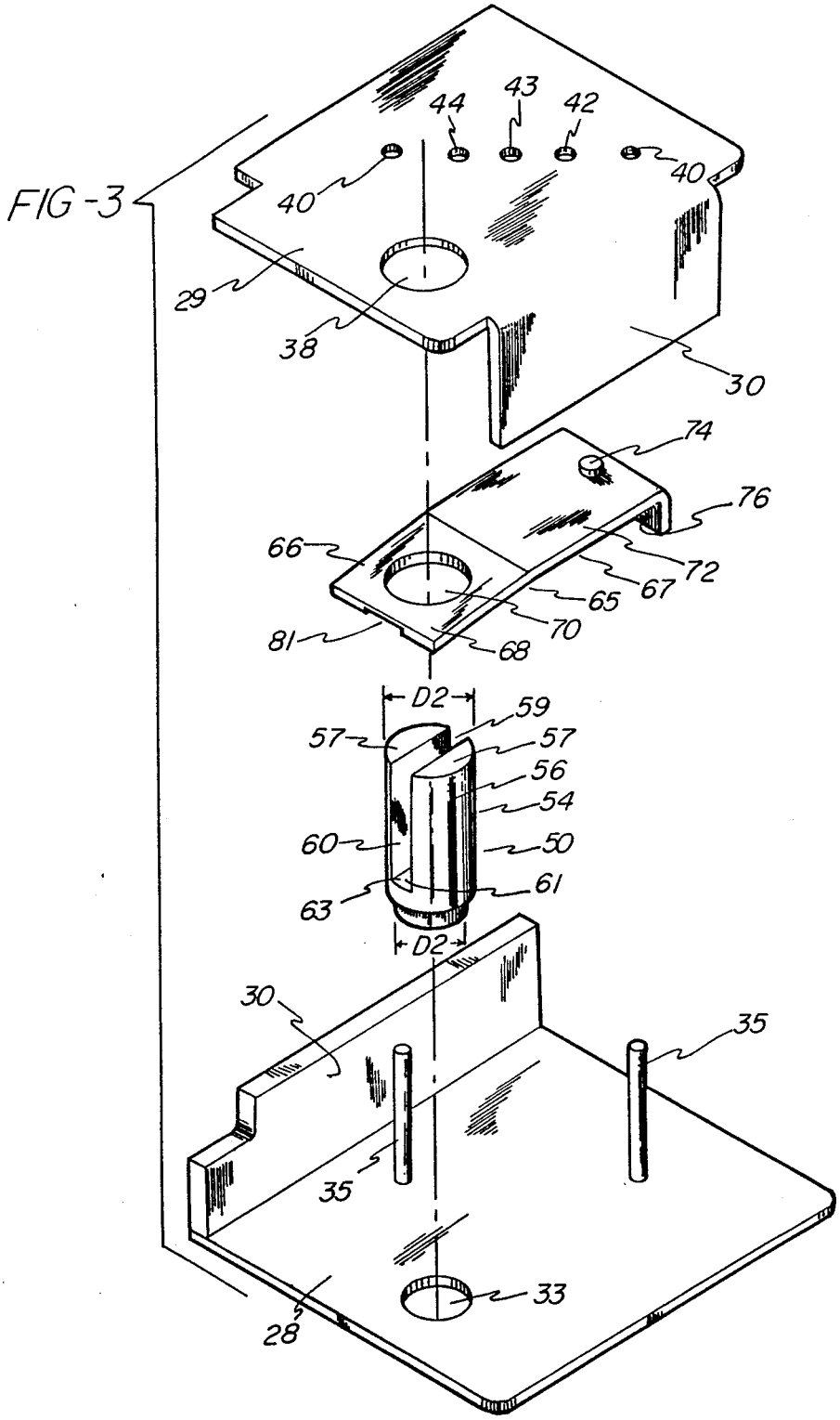
FIG. 3 is an exploded perspective view showing the components of the stirrup assembly shown in FIG. 2, absent the limb support bar.

As can be seen in FIGS. 2 and 3, a unique stirrup adjustment assembly 25 is provided for longitudinal and lateral control of the limb support bar 16 and stirrups 18. The stirrup adjustment assembly 25 is positioned near the foot of the table 10, so as to enclose limb support bar 16 as shown in FIG. 2. The stirrup adjustment assembly comprises a housing 27 having a bottom 28, top 29, and sidewall 30, all of which are preferably fabricated of metal. As can best be seen in FIG. 3, the bottom 28 of the housing 27 has therein a first aperture 33. Extending upwardly from bottom 28 are a pair of angular displacement stops 35 to restrain lateral movement of the limb support bar 16 beyond a desirable angle.

The top 29 is provided with a second aperture 38 and angular displacement receptors 40 which correspond in number and relative placement to the angular displacement stops 35, so that the tops of the angular displacement stops 35 may be inserted and secured in the receptors 40. Also shown in FIGS. 2 and 3 are a plurality of openings 42, 43, 44, which function as first, second and third angular displacement retention means. As shown, each of the angular displacement retention means 42, 43 and 44 is a circular aperture which extends completely through top 29 and has a dimension in the preferred embodiment of approximately 0.25", while the thickness of the top 29 is approximately 0.125".

The stirrup assembly 25 of this invention also includes a pivot boss 50 mounted in housing 27 for rotation about a substantially vertical axis and comprising a base 52 of a diameter D-1 and an upper portion 54 having a diameter of D-2, wherein the first diameter D-1 is less than the second diameter D-2. The upper portion 54 includes an outer surface 56, a top surface 57, a U-shaped channel 59 having channel sidewalls 60 and a channel bottom 61 which is perpendicular to the channel sidewalls 60. The channel 59 slidably receives the limb support bar. While the pivot boss 50 could be fabricated from steel or aluminum, the preferable embodiment of the invention includes a pivot boss manufactured from a suitable plastic material.

The channel bottom 61 includes a first limb support bar engaging surface 63, which in the operative mode of the examination table 10 serves to contact the bottom surface of the limb supporting bar 16 to assist in locking the bar at a particular longitudinal position. The dimensions associated with the pivot boss 50 in a preferred embodiment of the invention are as follows: the diameter D-2 of the pivot boss is approximately 1.00" with the channel having a width of approximately 0.375". The height of the base is approximately 0.125" and its diameter D-1 is approximately 0.75". The height of the upper portion is approximately 1.50" and the height of the slot sidewalls is approximately 0.875".

Figure 4:
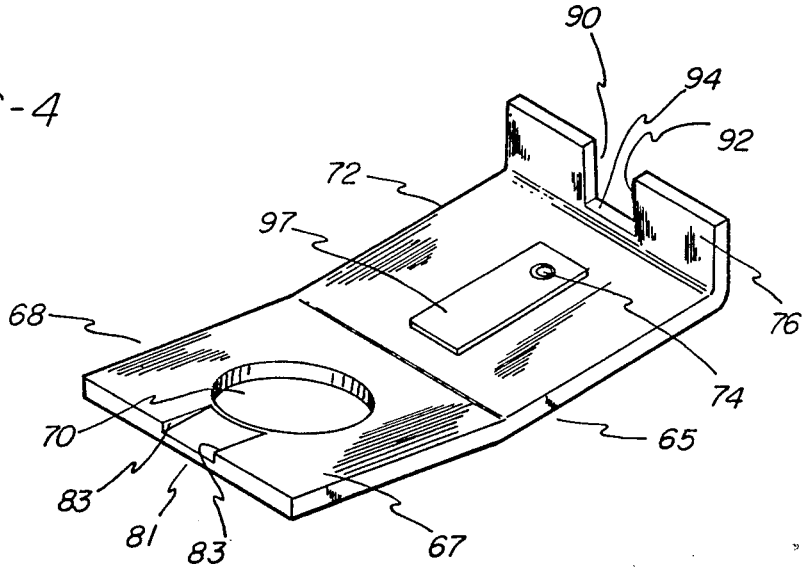
FIG. 4 is a perspective view of the bottom of the locking shoe shown in FIG. 3.
Figure 5:
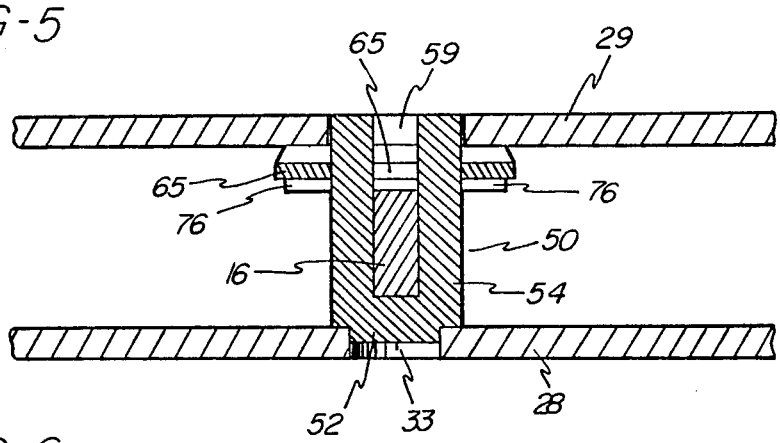
FIG. 5 is a vertical sectional view on an enlarged scale taken along line 5—5 of FIG. 2.

The invention also includes a locking shoe 65, which is shown best in FIGS. 3 and 4. The locking shoe has a top surface 66, a bottom surface 67, a front portion 68 having formed therein an aperture 70 and a rear portion 72. The included angle between the front and rear portions 68, 72 is approximately 170°. As can also be seen, the locking shoe 65 includes a downwardly extending portion 76. As can best be seen in FIG. 4, the bottom surface of the locking shoe 65 includes a first slot 81 having first slot sidewalls 83, and a second slot 90 having sidewalls 92 and a second limb support bar engaging surface 94, which is shown as being formed perpendicular to the slot sidewalls 92. In operation, the limb support bar may have its upper surface in frictional engagement with the second limb support bar engaging surface 94 and its lower surface in frictional engagement with the first limb support bar engaging surface 63 to lock the limb support bar in a desired longitudinal position.

Figure 6:
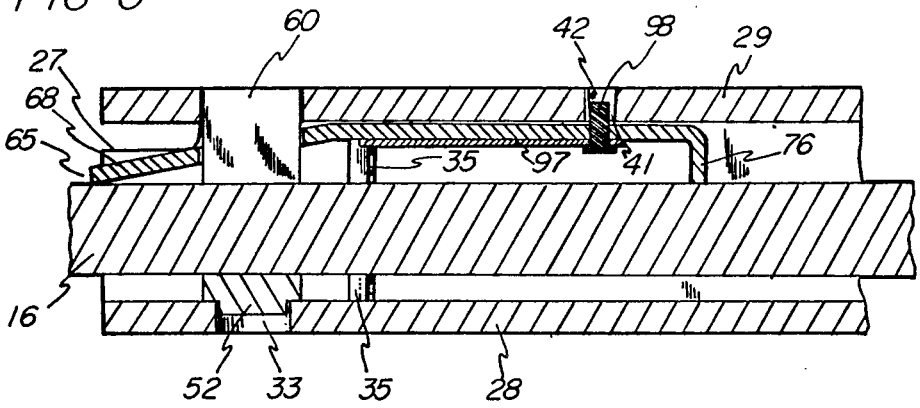
FIG. 6 is a vertical sectional view on an enlarged scale taken along line 6—6 of FIG. 2.

As can best be seen in FIGS. 4 and 6, a spring plate 97 is attached by welding or the like adjacent is lefthand end as seen in FIG. 6 to the bottom surface 67 of the locking shoe 65. A locking pin 98 is secured to a free end of the spring plate 97, the right-hand end as seen in FIG. 6, and extends upwardly through the locking shoe itself for cooperative engagement in the angular displacement retention means 42, 43 and 44. The angular displacement retention means provide for selective angular adjustment of the limb support bar 16 in a generally horizontal direction. The presence of the spring plate 97 permits the locking pin 98 to be depressed when lateral angular displacement of the limb support bar is desired. For example, when the limb support bar 16 is in the position shown in FIG. 2 at A, the bar is perpendicular to the end of the table 10. In the position designated a B, the bar is approximately 15° from position A. Further, when the bar is in the position shown as C, the bar is approximately 30° from the position shown as A.

Figure 7:
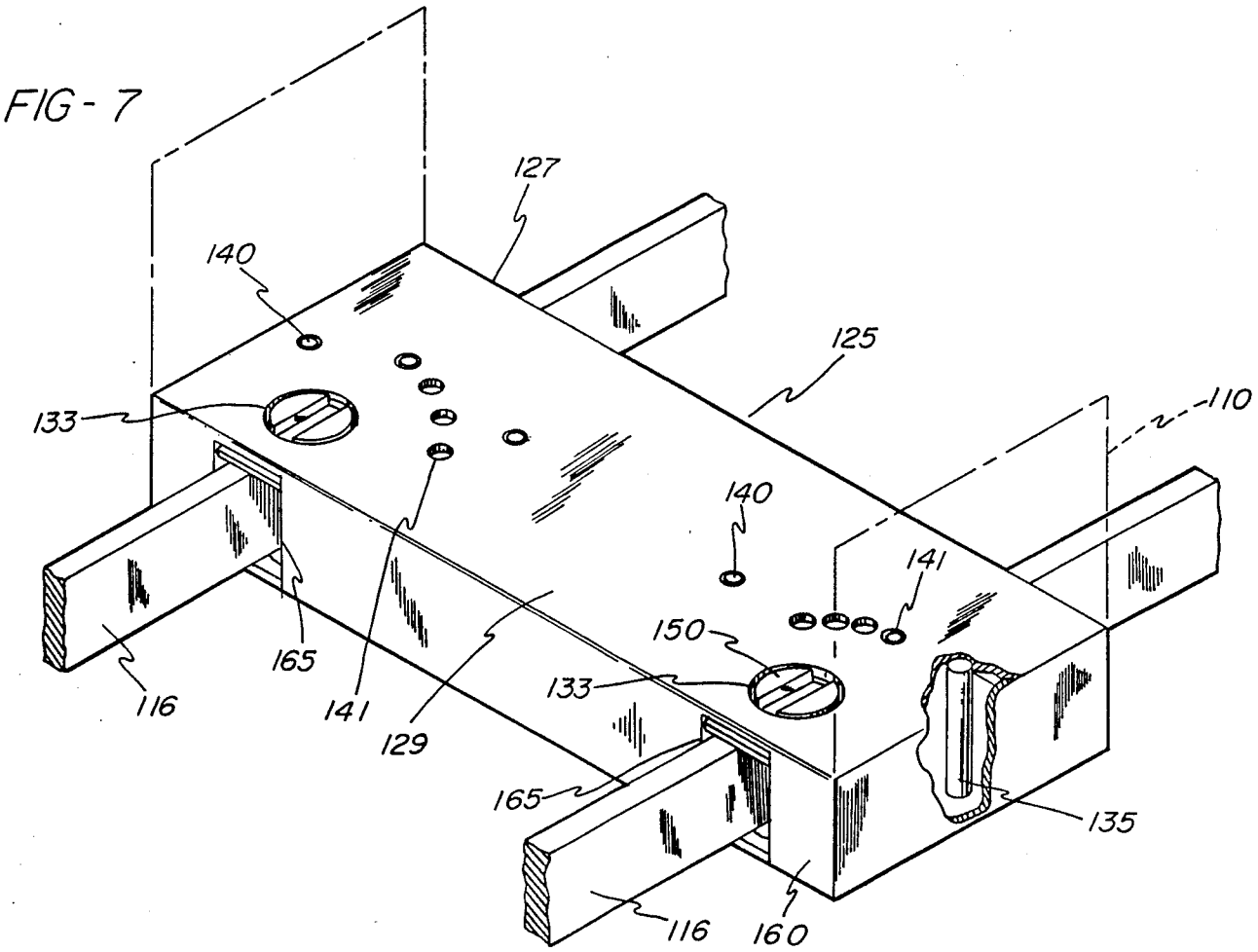
FIG. 7 is a perspective view of a modified embodiment of the stirrup assembly in accordance with the present invention.

In actual fabrication, the table 10 may include two stirrup assemblies having separate housings, or one housing could incorporate two stirrup assemblies as shown in FIG. 7. In such an embodiment, a modified patient support table, a portion of the structure of which is shown at 110, includes a pair of limb support bars 116, a stirrup (not shown) being mounted on the terminal end of each limb support bar. Limb support bars 116 are slidably adjustable in a longitudinal direction with respect to table 110, with removal of the limb support bars 116 being prevented by bar retaining pins identical to that shown at 22 in FIG. 2 and located on the upper surfaces of the limb support bars 116.

The modified stirrup adjustment assembly 125 of this invention includes a housing 127 having a planar top 129 preferably fabricated of metal and welded to the structural components of table 110. As in the previously discussed embodiment, a first aperture 133 is provided in the top panel 129. Extending downwardly from top 129 is at least one angular displacement stop 135. Preferably a pair of such angular displacement stops are provided to restrain lateral movement of the limb support bar beyond a desirable angle. The top may also be provided with angular displacement receptors 140, which function as do angular displacement receptors 40. A plurality of recessed areas 141, shown in the modified embodiment as four circular apertures, extend completely through top 129. The apertures each have a dimension of approximately 0.25", while the thickness of the top 129 is approximately 0.125".

The stirrup assembly 125 of this invention also includes a pivot boss 150 comprising a base and an upper portion. The structure of pivot boss 150 is preferably identical to pivot boss 50. The upper and base portions of pivot boss 150 are received in openings in housing 127 in a manner identical to boss 50 and housing 27. The embodiment of the invention shown in FIG. 7 also includes a locking shoe which is constructed and functions the same as locking shoe 65. As can be seen in FIG. 7, a front plate 160 is part of the housing, extending downwardly from the top 129 of the housing and having formed therein a pair of limb support bar passages 165.

As with the embodiment of the invention shown in FIGS. 1–6, the embodiment of the invention shown in FIG. 7 operates in approximately the same way. The locking shoes are positioned beneath their respective apertures in the top of the housing. The corresponding pivot boss is passed through that aperture and its base may be in contact with an aperture in the bottom of the housing. The limb support bar may then be inserted through the channel and the bar retaining pin may be screwed or secured in place. In actual operation, tables having either of the embodiments of this invention will operate, with respect to the stirrup assemblies, in substantially the same way.

Figure 8:
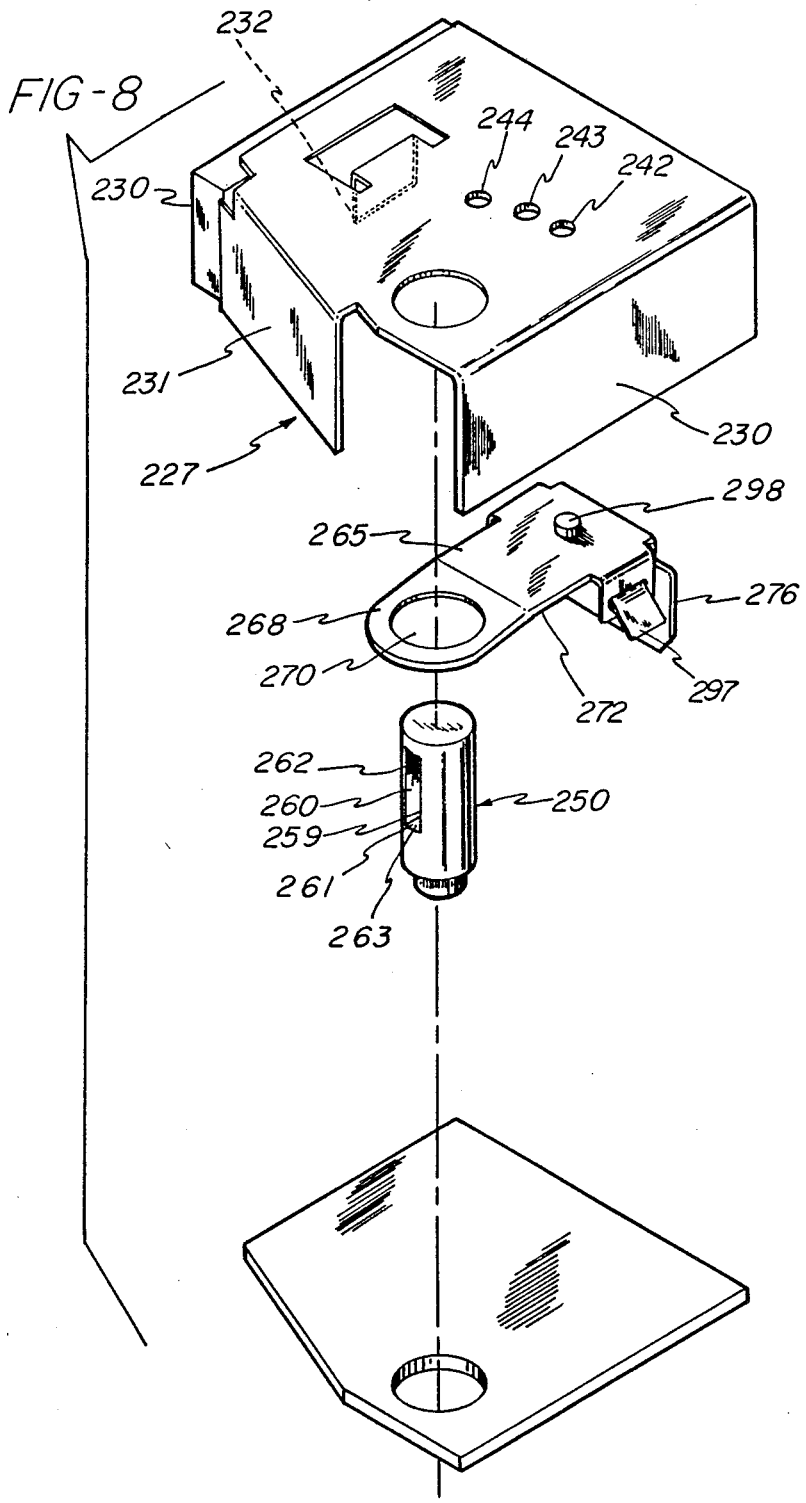
FIG. 8 is an exploded perspective view showing components of the stirrup assembly in accordance with another modified embodiment of the invention.
Figure 9:
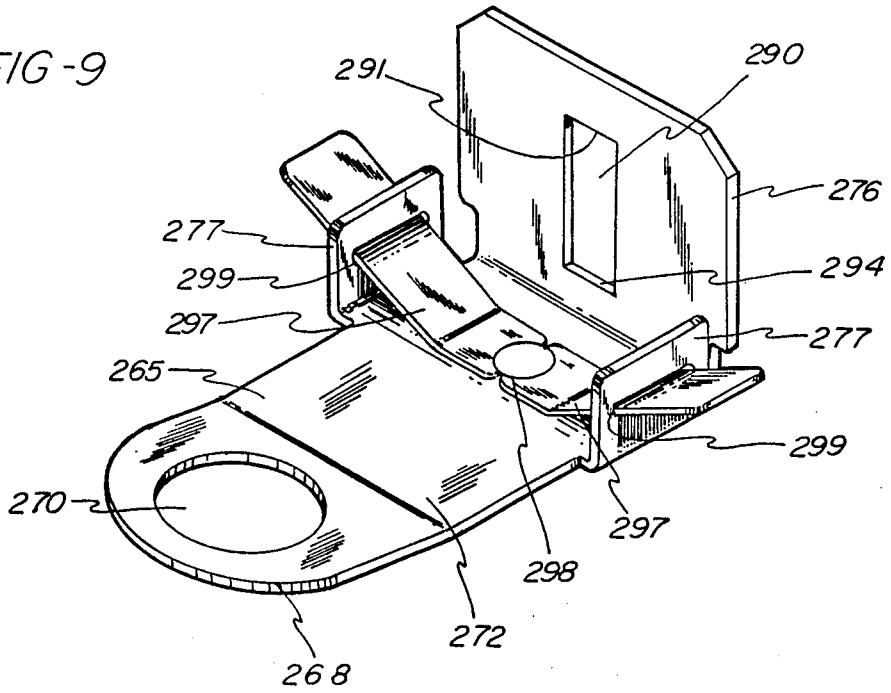
FIG. 9 is a perspective view of the bottom of the locking shoe shown in the embodiment of FIG. 8.

The embodiments of FIGS. 1–7 may be further modified by the elements shown in FIGS. 8 and 9. As seen in FIG. 8, a pivot boss 250 is provided having a channel 259 defined by side walls 260, and lower and upper walls 261, 262, respectively, which are perpendicular to the channel sidewalls 260. As in the previous embodiments, the channel includes a first limb support bar engaging surface 263 which serves to contact the bottom surface of the limb supporting bar to assist in locking the bar at a particular longitudinal position. In addition, the opposing surface of the channel provides a more secure fit than the previous embodiment for guiding the bar in its movement.

As can also be seen in FIG. 8, the housing may be modified to include a front wall 231 in addition to the side walls 230. Further, the receptors 40 and stops 35 of the previous embodiments may be eliminated and replaced by a bent tab 232 and one of the side walls 230 to serve as means for limiting the angular displacement of the bar. Thus, fewer parts are required and construction of the housing is facilitated since the need to align the stops with the receptors when assembling the housing is eliminated.

As may be seen in FIG. 9, the locking shoe has also been modified and includes a locking pin 298 attached to locking shoe 265 for engagement with angular displacement retention means 242, 243 and 244 located on the housing 227. The locking pin 298 is mounted to a spring plate which is formed with oppositely extending wings 297. The outer ends of the wings 297 are received in apertures 299 formed in tabs 277 extending downwardly from either side of a rear portion 272 of the locking shoe 265. Thus, the locking pin 298 is resiliently mounted to and extends upwardly through the locking shoe 265 to position the bar at the selected positions defined by the retention means 242, 243 and 244.

In addition, the locking shoe 265 has a front portion 268 with an aperture 270 formed therein, with the front portion 268 formed at an angle to the rear portion 272, as in the previous embodiments. The locking shoe 265 further includes a downwardly extending portion 276 having an aperture 290 formed therein, with an upper wall forming a second limb support bar engaging surface 294 which operates to lock the limb support bar in a desired longitudinal position in the same manner as described for the previous embodiments. The aperture 290 of the locking shoe 265 has a lower wall 291 for engaging a lower surface of the limb support bar, which serves to pivot the locking shoe 265 away from the upper wall 229 of the housing 227 for disengaging the locking pin 298 from the retention means 242, 243 and 244 and permitting pivotal movement of the bar. The lower wall 291 additionally provides a rest surface along which the bar may slide as it is moved longitudinally.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. In combination with an examination table, a stirrup assembly including a housing mounted in said table, a limb support bar extending through said housing and a stirrup fixed to an outer end of said limb support bar, the improvement comprising:

a pivot boss mounted in said housing for rotational movement about a substantially vertical axis, means defining an opening through said pivot boss slidably receiving said limb support bar for longitudinal movement thereof, a locking shoe carried by said pivot boss for rotational movement with said pivot boss, and locking means carried by said locking shoe and engageable with portions of said housing for fixing said limb support bar against pivotal movement about said vertical axis.

2. The combination of claim 1 wherein said locking means carried by said locking shoe comprises pin means projecting from said locking shoe and openings formed in said housing and positioned to receive said pin means.

3. The combination of claim 2 wherein said openings in said housing are substantially arcuately disposed about said vertical axis.

4. The combination of claim 2 further comprising means resiliently mounting said pin means and urging it into engagement with selected ones of said openings in said housing.

5. The combination of claim 4 wherein said means resiliently mounting said pin comprises a resilient plate fixed to a lower surface of said locking shoe and urging said pin means through an opening formed in said locking shoe.

6. The combination of claim 4 wherein said means resiliently mounting said pin comprises a pair of resilient leafs attached to opposite sides of said locking shoe and urging said pin means through an opening formed in said locking shoe.

7. The combination of claim 1 further comprising a pivot boss receiving opening formed in said locking shoe with said pivot boss extending through said pivot boss receiving opening.

8. The combination of claim 1 wherein said locking shoe includes inner and outer plate-like portions angularly disposed with respect to each other.

9. The combination of claim 8 wherein said inner portion of said locking shoe has a down-turned lip at an inner edge of said inner portion and means defining a slot in said down-turned lip receiving said limb support bar.

10. The combination of claim 9 wherein said limb support bar engages a lower wall of said opening through said pivot boss and upper wall of said slot in said down-turned lip of said locking shoe for frictionally restraining said limb support bar against longitudinal movement thereof.

11. The combination of claim 10 wherein said limb support bar further engages an upper wall of said opening through said pivot boss for guiding said limb support bar during longitudinal movement thereof, and said limb support bar engages a lower wall of said slot in said down turned lip of said locking shoe for disengaging said locking means carried by said locking shoe from said portions of said housing fixing said limb support bar against pivotal movement.

12. The combination of claim 1 further comprising stop means carried by said housing and engageable by said locking shoe to limit pivotal movement of said limb support bar about said vertical axis.

13. In combination with an examination table, a pair of stirrup adjustment assemblies including housing means mounted in said table, limb support bars received in and extending through said housing means and stirrups fixed to outer ends of said limb support bars, the improvement comprising:

said housing means being of box-like construction and including top and bottom walls and interconnecting side walls, a substantially rod-like pivot boss having a lower end of reduced diameter with respect to an upper end thereof, means defining substantially aligned, circular openings in said housing top and bottom walls and rotatably receiving said upper and lower ends of said pivot boss, means defining a slot through said pivot boss spaced upwardly from said lower end thereof, said slot having a bottom wall and spaced sidewalls, a limb support bar extending through said slot intermediate said housing top and bottom walls and engageable with said bottom wall of said slot, a locking shoe having outer and inner portions angularly disposed with respect to each other and defining therebetween an obtuse included angle, means defining an opening through said outer portion of said locking shoe receiving said upper portion of said pivot boss, said inner portion of said locking shoe including a lip extending downwardly from an inner edge of said inner portion, means defining a downwardly opening slot in said lip, said downwardly opening slot including a top wall and spaced sidewalls, said locking shoe being positioned within said housing above said limb support bar and with said limb support bar extending through said slot in said lip and engageable with said top wall of said downwardly opening slot, a resilient leaf fixed adjacent an outer end thereof to a lower surface of said locking shoe adjacent an intersection of said inner and outer portions thereof, means defining an opening through said inner portion of said locking shoe outwardly of said inner edge thereof, a locking pin mounted on an upper surface of said resilient leaf adjacent an inner end thereof and urged upwardly through said opening through said inner portion of said locking shoe, means defining a plurality of arcuately disposed apertures through said top wall of said housing adapted to receive said locking pin as said locking shoe is rotated about said vertical axis, stops extending between said top and bottom walls of said housing and limiting movement of said boss, limb support bar and locking shoe about said vertical axis, and a retaining pin fixed to said limb support bar to retain said limb support bar in said housing.

14. In combination with an examination table, a pair of stirrup adjustment assemblies including housing means mounted in said table, limb support bars received in and extending through said housing means and stirrups fixed to outer ends of said limb support bars, the improvement comprising:

said housing means being of box-like construction and including top and bottom walls and interconnecting side walls, a substantially rod-like pivot boss having a lower end of reduced diameter with respect to an upper end thereof, means defining substantially aligned, circular openings in said housing top and bottom walls and rotatably receiving said upper and lower ends of said pivot boss, means defining a slot through said pivot boss spaced upwardly from said lower end thereof, said slot having a top wall, a bottom wall and spaced sidewalls, a limb support bar extending through said slot intermediate said housing top and bottom walls and engageable with said top and bottom walls of said slot, a locking shoe having outer and inner portions angularly disposed with respect to each other and defining therebetween an obtuse included angle, means defining an opening through said outer portion of said locking shoe receiving said upper portion of said pivot boss, said inner portion of said locking shoe including a lip extending downwardly from an inner edge of said inner portion, means defining a slot in said lip, said slot in said lip including a top wall, a bottom wall and spaced sidewalls, said locking shoe being positioned within said housing above said limb support bar and with said limb support bar extending through said slot in said lip and engageable with said top and bottom walls thereof, means defining an opening through said inner portion of said locking shoe outwardly of said inner edge thereof, said inner portion of said locking shoe including tabs extending downwardly from opposite sides thereof, means defining an aperture in each of said tabs, resilient leafs extending from said tabs to said opening through said inner portion of said locking shoe, each of said apertures in said tabs receiving an end of one of said resilient leafs, a locking pin attached to an end of each of said resilient leafs opposite from said end passing through said apertures in said tabs, said locking pin being urged upwardly through said opening through said inner portion of said locking shoe, means defining a plurality of arcuately disposed apertures through said top wall of said housing adapted to receive said locking pin as said locking shoe is rotated about said vertical axis, stops extending between said top and bottom walls of said housing and limiting movement of said boss, limb support bar and locking shoe about said vertical axis, and a retaining pin fixed to said limb support bar to retain said limb support bar in said housing.

* * * * *